US008672580B1

(12) United States Patent
Garceau

(10) Patent No.: US 8,672,580 B1
(45) Date of Patent: Mar. 18, 2014

(54) APPARATUS AND METHOD FOR IMPRINTING A CURVED PATHWAY IN CONCRETE

(71) Applicant: Jerome V. Garceau, Warrenville, IL (US)

(72) Inventor: Jerome V. Garceau, Warrenville, IL (US)

(73) Assignee: Butterfield Color, Inc., Aurora, IL (US)

( * ) Notice: Subject to any disclaimer, the term of this patent is extended or adjusted under 35 U.S.C. 154(b) by 0 days.

(21) Appl. No.: 13/772,724

(22) Filed: Feb. 21, 2013

(51) Int. Cl.
*E01C 19/44* (2006.01)

(52) U.S. Cl.
USPC ..... 404/75; 404/89; 404/93

(58) Field of Classification Search
USPC ..... 404/89, 93, 72, 17, 75, 83; 180/9
See application file for complete search history.

(56) References Cited

U.S. PATENT DOCUMENTS 1,689,164 A * 10/1928 Sylvester ..... 404/17
2,667,349 A * 1/1954 Jacobson ..... 482/78
3,910,711 A * 10/1975 Moorhead ..... 404/89
4,105,354 A * 8/1978 Bowman ..... 404/72
4,135,840 A * 1/1979 Puccini et al. ..... 404/93
4,776,723 A * 10/1988 Brimo ..... 404/89
4,838,728 A * 6/1989 McKeever ..... 404/89
5,406,763 A * 4/1995 Al-Saleh ..... 52/311.1
5,487,526 A * 1/1996 Hupp ..... 249/2
5,487,656 A * 1/1996 Kaitanjian ..... 425/385
5,494,372 A * 2/1996 Oliver et al. ..... 404/72
6,588,975 B2 * 7/2003 Ross ..... 404/75
8,133,540 B2 * 3/2012 Wiley et al. ..... 427/372.2
2013/0177354 A1 * 7/2013 Farrell ..... 404/75

* cited by examiner

*Primary Examiner* — Raymond W Addie
(74) *Attorney, Agent, or Firm* — Pauley Petersen & Erickson

(57) ABSTRACT

This invention relates to an apparatus for simulating the appearance of individually laid materials, such as bricks or cobblestones, in a curved pattern in a concrete surface. The apparatus includes a flexible spine with a plurality of ribs extending from a surface of the flexible spine. The apparatus further includes a texture mat for imprinting a pattern, for example a brick surface, a stone surface or a wood grain surface, into the concrete surface. This invention also relates to a method of using of the apparatus for simulating the appearance of individually laid materials in the concrete surface.

19 Claims, 5 Drawing Sheets

APPARATUS AND METHOD FOR IMPRINTING A CURVED PATHWAY IN CONCRETE

BACKGROUND OF THE INVENTION

1. Field of the Invention

This invention relates to an apparatus and method for stamping and texturing concrete in a curved pattern.

2. Discussion of Related Art

Many architects and designers incorporate pathways and driveways created from individually laid bricks or stones into their projects. Such pathways and driveways provide an extremely durable and aesthetically pleasing appearance that, until recently, could not be matched by other techniques for creating pathways and driveways. However, such individually laid brick and stone pathways have high material and labor costs when compared to other techniques.

Recently, techniques for coloring and forming concrete have been developed that recreate the appearance of individually laid bricks and stones but at a significantly lower cost. These techniques include forming impressions of bricks, cobblestones, slate, etc. with hand tools, such as chisels, touch-up wheels and concrete stamps that include impressions that impart desired shapes and textures onto uncured concrete. These techniques can be used to simulate a variety of materials including, but not limited to, brick, cobblestone, slate, and wood flooring. While these methods work well for bricks and stones in straight patterns, these methods do not work as well for curved patterns. Such as a continuous arrangement of bricks in a curved pattern, often referred to as a "soldier course." Curved patterns require the creation of a new concrete stamp for each change in radius that may be required.

FIG. 1 shows one known embodiment of a concrete stamp 100 for a curved soldier course pattern. In this known embodiment, the concrete stamp 100 includes a raised border 102 and a negative relief 104 of a plurality of stones. When pressed into uncured concrete, the raised border 102 creates an appearance of mortar while the negative relief 104 creates an appearance of stones. Because the concrete stamp 100 is formed as a solid unit with the raised border 102 surrounding the stamp 100 and the negative relief 104 extending between the raised borders 102, a radius 106 of the stamp 100 is fixed and cannot be altered. Thus, this arrangement requires the creation of a new concrete stamp for each change in radius in a pattern, increasing both costs and labor. Alternatively, the driveway or walkway configuration must be altered to fit the pre-determined radius.

Accordingly, there is a need for a concrete stamping tool which can be adapted to form curved patterns with various radii.

SUMMARY OF THE INVENTION

A general object of the invention is to provide a method and apparatus for creating curved soldier courses with various radii. The apparatus and method can simulate the look of individually laid materials, including, but not limited to bricks, cobblestones, slate and wooden flooring materials.

The general object of the invention can be attained, at least in part, through a concrete stamp which includes a flexible spine with a plurality of ribs extending generally perpendicular from the flexible spine. Preferably the flexible spine is movable from a generally straight or linear profile to a curved profile. In the curved profile, the plurality of ribs extend generally perpendicular from a tangent of the curved profile.

In a preferred embodiment, the flexible spine and the plurality of ribs further include a tapered edge to create a simulated mortar line in the concrete. The apparatus may further include a textured surface to simulate the look of the material and/or mortar.

The invention also preferably includes a textured mat with a negative relief of the material sought to be simulated. The textured mat provides a desired texture to a surface of the uncured concrete that is not imprinted by the concrete stamp.

The method of creating the curved soldier course with the apparatus of this invention includes first laying and leveling concrete in an area where the design is desired. Second, the flexible spine is curved to a desired radius while preferably making sure that each of the plurality of ribs is equally spaced from each adjacent rib. The flexible spine and the plurality of ribs are pressed into the uncured concrete to a desired depth to form at least a portion of a border of a simulated material, such as a cobblestone or a brick, and mortar lines. Preferably, the method further includes a step of applying the textured mat to the uncured concrete to simulate the surface of the simulated material, for example, but not limited to, a brick surface, a stone surface or a wood grain surface.

BRIEF DESCRIPTION OF THE DRAWINGS

These and other objects and features of this invention will be better understood from the following detailed description taken in conjunction with the drawings, wherein.

DESCRIPTION OF PREFERRED EMBODIMENTS

Figure 9:
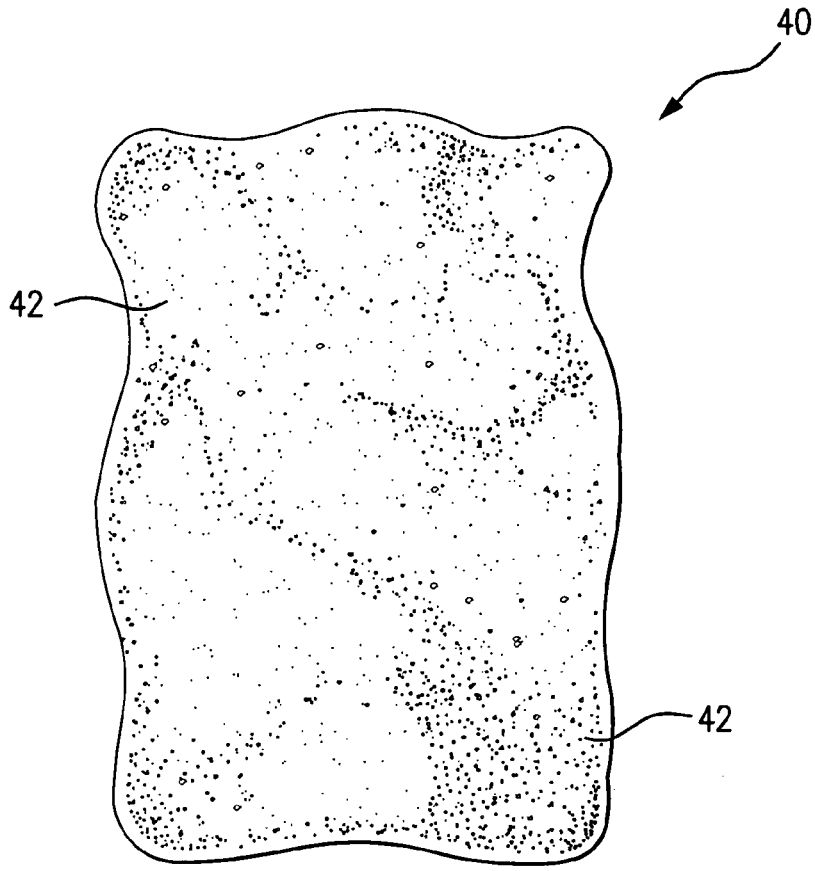
FIG. 9 is a bottom view of a textured mat according to an embodiment of this invention.

This invention provides an apparatus and method for stamping uncured concrete to simulate the look of individually laid materials in a curved pattern. FIGS. 2-5 show a concrete stamp 10 for creating at least a partial border of the simulation of the individually laid materials according to an embodiment of this invention. FIG. 9 shows a textured mat 40 for imprinting a material surface simulation in uncured concrete. By using the method of this invention and by appropriately designing the concrete stamp 10 and the textured mat 40, simulations of a variety of individually laid materials may be created including, but not limited to, bricks, slate, cobblestones and wood planks.

Figure 1:
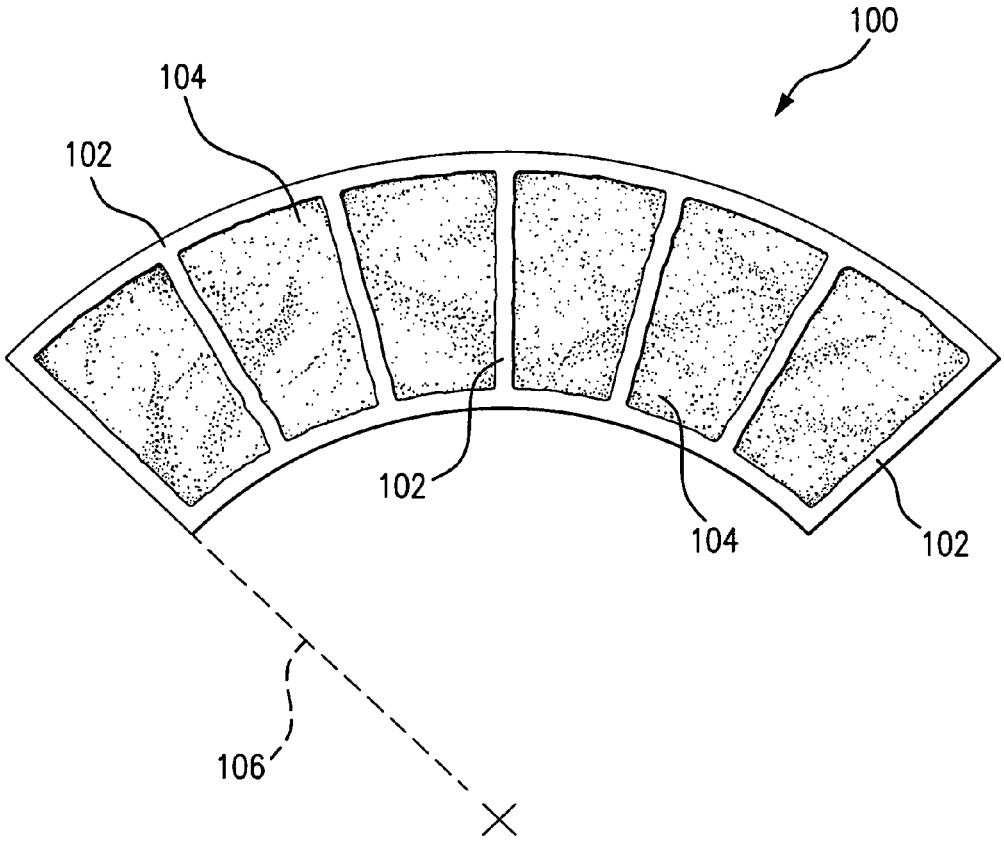
FIG. 1 PRIOR ART
FIG. 1 is a bottom view of a known concrete stamp for imprinting a curved pattern into uncured concrete.
Figure 2:
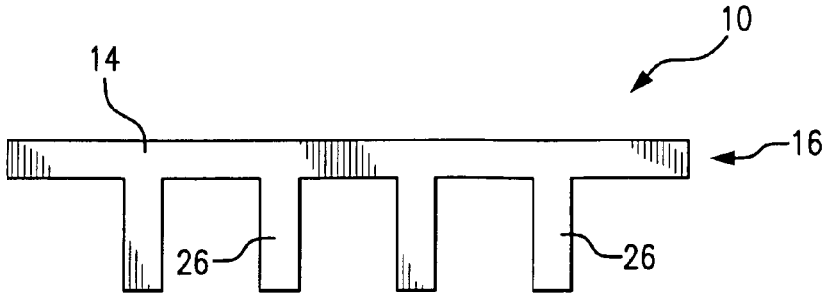
FIG. 2 is a top view of a concrete stamp in a linear profile, according to an embodiment of this invention.

FIG. 2 shows a top view of the concrete stamp 10 for simulating the look of individually laid materials according to an embodiment of this invention. For example, but not limited to, bricks laid in a curved soldier or sailor pattern. In this embodiment, the concrete stamp 10 includes a flexible spine 14 with a plurality of ribs 26, the flexible spine 14 movable from a generally linear profile 16, as shown in FIG. 2, to a plurality of curved profiles including the curved profile 18 shown in FIG. 5.

As shown in the embodiment of FIGS. 2-5, the plurality of ribs 26 extend generally perpendicular from the flexible spine 14. Further, each of the plurality of ribs 26 are generally straight and are equally spaced from each adjacent rib. With this arrangement of straight edges, the flexible spine 14 and the plurality of ribs 26 simulate the look of individually laid bricks when the concrete stamp 10 is pressed into concrete. In an alternative embodiment, the flexible spine 14 and/or plurality of ribs 26 can be crooked and/or irregularly spaced to impart, for example, a curved cobblestone pattern of irregularly shaped and/or sized stones.

In a preferred embodiment of the concrete stamp 10, the flexible spine 14 and the plurality of ribs 26 are formed as a unified structure and made of semi-rigid polyurethane. Alternatively, the flexible spine 14 and the plurality of ribs 26 may be made of any material which allows the concrete stamp 10 to bend to a desired radius 20 and capable of withstanding a pressure required to imprint concrete, including, but not limited to neoprene rubber, polyvinyl chloride and polystyrene foam. Preferably, the concrete stamp 10 can be washed for repeated use.

Figure 3:
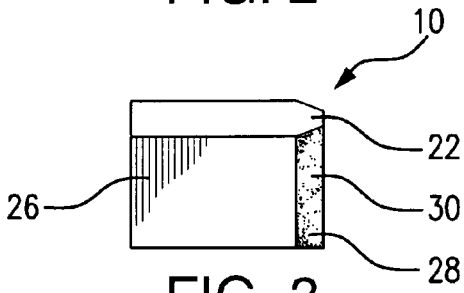
FIG. 3 is a side view of the concrete stamp of FIG. 2.
Figure 4:
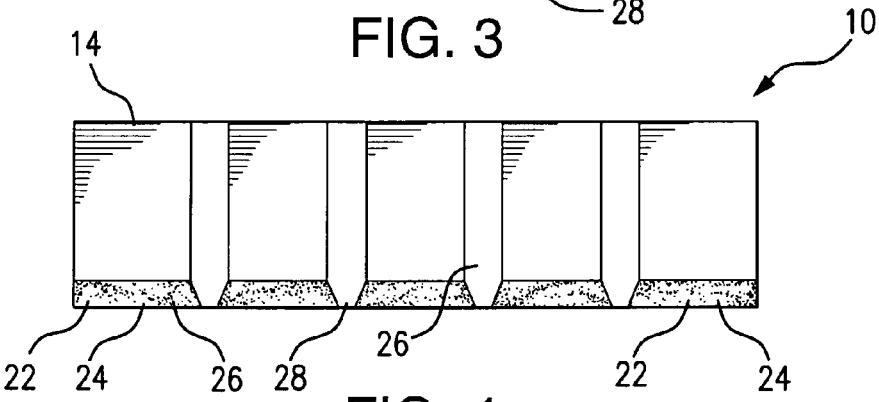
FIG. 4 is a front view of the concrete stamp of FIG. 2.
Figure 5:
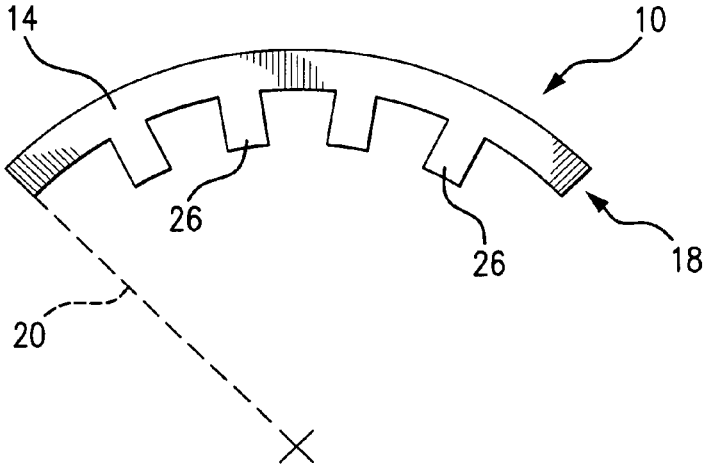
FIG. 5 is a top view of the concrete stamp of FIG. 2 in a curved profile.

According to an embodiment of this invention and as shown in FIGS. 3 and 4, the flexible spine 14 further includes a spine tapered edge 22 and each of the plurality of ribs further include a rib tapered edge 28. When pressed into concrete, the spine tapered edge 22 and the rib tapered edge 28 create a look of a brick edge and mortar around a portion of a brick perimeter. Alternatively, the flexible spine 14 and/or the plurality of ribs 26 may not include a tapered edge and may include an uneven edge that simulates, for example, an uneven cobblestone edge when pressed into concrete. Preferably, the flexible spine 14 and the plurality of ribs 26 also include a textured surface 24, 30. The textured surface 24, 30 is a negative relief of surface features that are to be imprinted into the concrete, for example a rough surface of a brick or a grainy surface of mortar.

The concrete stamp 10 of this invention can be any desired size and/or shape to create the look of various types of materials including, but not limited to, bricks, cobblestones, slate, and wooded surfaces. In an embodiment of this invention that creates a simulated look of a curved soldier course of bricks, the flexible spine 14 is about 1.5 cm thick, about 80 cm long and about 6 cm tall. Further, the plurality of ribs are about 1.5 cm thick, about 20 cm long and about 6 cm tall. However, the concrete stamp may include any dimensions.

Figure 6:
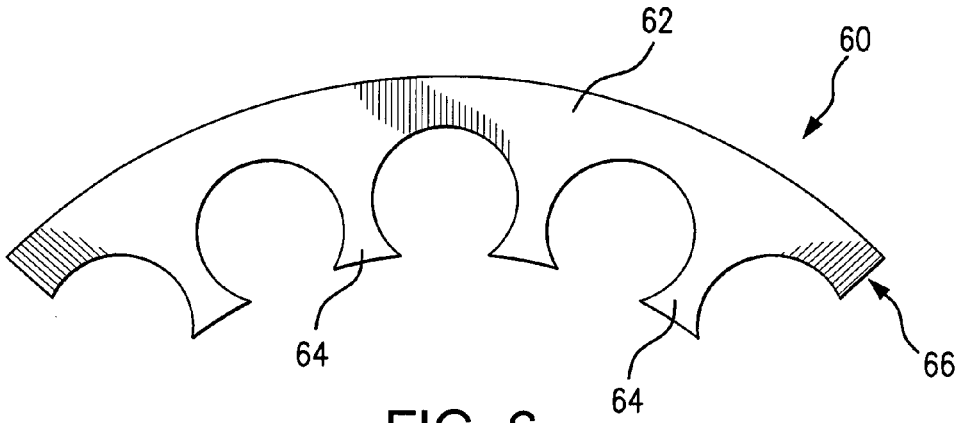
FIG. 6 is a top view of an embodiment of the concrete stamp of this invention in a curved profile.
Figure 7:
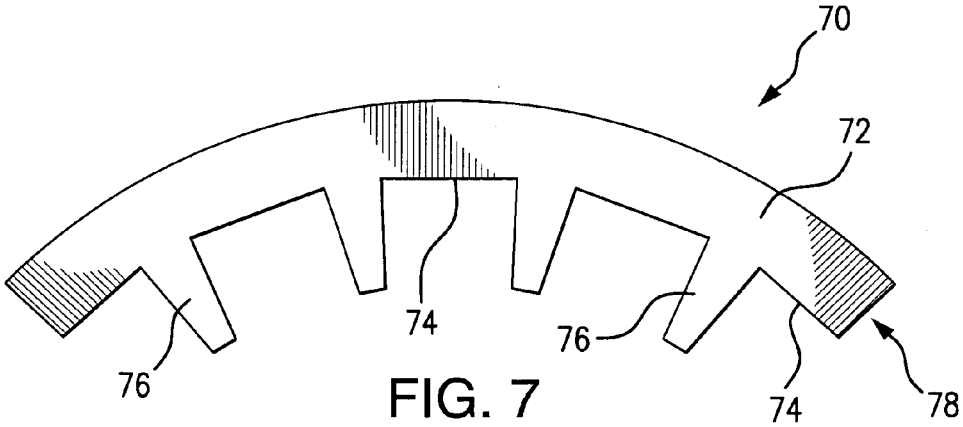
FIG. 7 is a top view of an embodiment of the concrete stamp of this invention in a curved profile.
Figure 8:
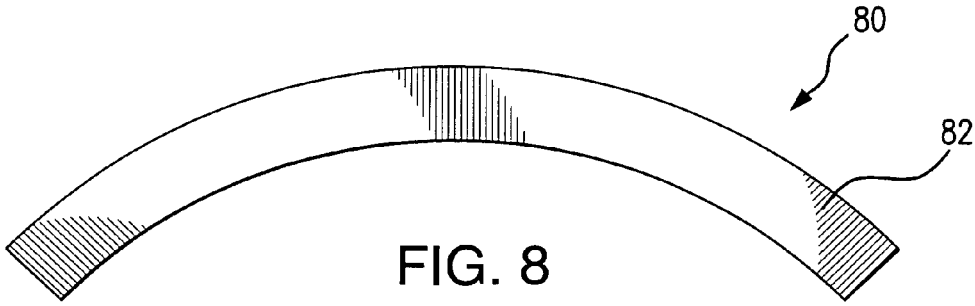
FIG. 8 is a top view of an embodiment of the concrete stamp of this invention in a curved profile.

FIGS. 6-8 show alternative embodiments of the concrete stamp of this invention. FIG. 6 shows a concrete stamp 60 with an irregularly shaped flexible spine 62 with irregularly shaped ribs 64 in a curved profile 66. The embodiment of FIG. 6 simulates the look of a curved cobblestone path.

FIG. 7 shows a concrete stamp 70 including a flexible spine 72 with flat sections 74 on at least one side of the flexible spine 72. Further, the concrete stamp 70 of FIG. 7 includes trapezoidal-shaped ribs 76 extending from the flexible spine 72 between the flat sections 74. In a curved profile 78, the concrete stamp 70 simulates the look of a curved path of rectangular bricks by creating an impression of rectangular bricks with gradually widening mortar joints between the rectangular bricks.

FIG. 8 shows a concrete stamp 80 with a flexible spine 82 and without a rib. The concrete stamp 80 of this embodiment is useful for completing a curved path of the material imprinted in uncured concrete by another concrete stamp 10, 60, 70.

As shown in FIG. 9, this invention further includes a textured mat 40 with a negative relief 42 of a surface of the material, for example, but not limited to, a rough surface of a brick, a cobblestone surface, a slate surface and a wood flooring surface. When used in combination with the concrete stamp 10, 60, 70, 80, the textured mat 40 simulates the look of individually laid components, such as bricks, cobblestones or slate. The textured mat 40 is preferably made of a pliable and flexible material, such as polyurethane. However, the textured mat 40 may be made of any material capable of withstanding a pressure required to imprint concrete and capable of withstanding repeated use, including, but not limited to, neoprene rubber, polyvinyl chloride and polystyrene foam. Preferably, the textured mat 40 can be washed for repeated use.

This invention also includes a method of using the concrete stamp 10 to form a curved pattern of the material, for example bricks or stones in a curved pattern. The method may include the following steps without limitation of order, combination, omission and/or repetition.

The method of using the concrete stamp 10 and textured mat 40 to simulate the look of individually laid bricks and/or stones in a curved pattern begin with the mixing, laying and leveling of concrete in a known method. This method may include framing the area to support edges of the laid concrete. Preferably, the laid concrete includes at least one concrete dye which mimics a color of the material to be simulated. The method of this invention may also include applying a release agent to a surface of the laid concrete to facilitate removal of the concrete stamp 10 and/or the textured mat 40 in subsequent steps. Preferably, the release agent includes at least one release agent dye that differs in color from the concrete dye to add depth and contrast to the simulated material. Alternatively, the release agent dye may match the concrete dye.

The method may include a step of curving the flexible spine 14 with the plurality of ribs 26 to a radius 20 and pressing the flexible spine 14 and the plurality of ribs 26 into a surface of uncured concrete 32 to imprint a simulated border of the material and to imprint a simulated mortar between the simulated materials. This step also includes removing the flexible spine 14 and the plurality of ribs 26 from the surface of the uncured concrete 32.

The method may include applying the textured mat 40 to the surface of the uncured concrete 32 and removing the textured mat 40 from the surface of the uncured concrete 32. Preferably, the textured mat 40 includes a negative relief of the surface of the material sought to be simulated, for example, the roughness of brick or the unevenness of cobblestones. Preferably, at least a portion of the release agent sticks to the textured mat 40 and is removed from the uncured concrete 32 allowing the concrete dye and a remaining release agent dye to contrast and better simulate the look of the material sought to be simulated. In an alternative embodiment, the textured mat 40 may be applied to the surface of the uncured concrete prior to the application of the flexible spine 14 and the plurality of ribs 26 to the surface of the uncured concrete.

The method may include curving a second flexible spine to a desired radius and pressing the second flexible spine into the surface of the uncured concrete 32. Preferably, the second flexible spine contacts the impression left by the flexible spine in the uncured concrete 32 to complete the border around the simulation of the material. In an embodiment, the second flexible spine includes a plurality of ribs. Alternatively, the second flexible spine may not include the plurality of ribs.

Figure 10:
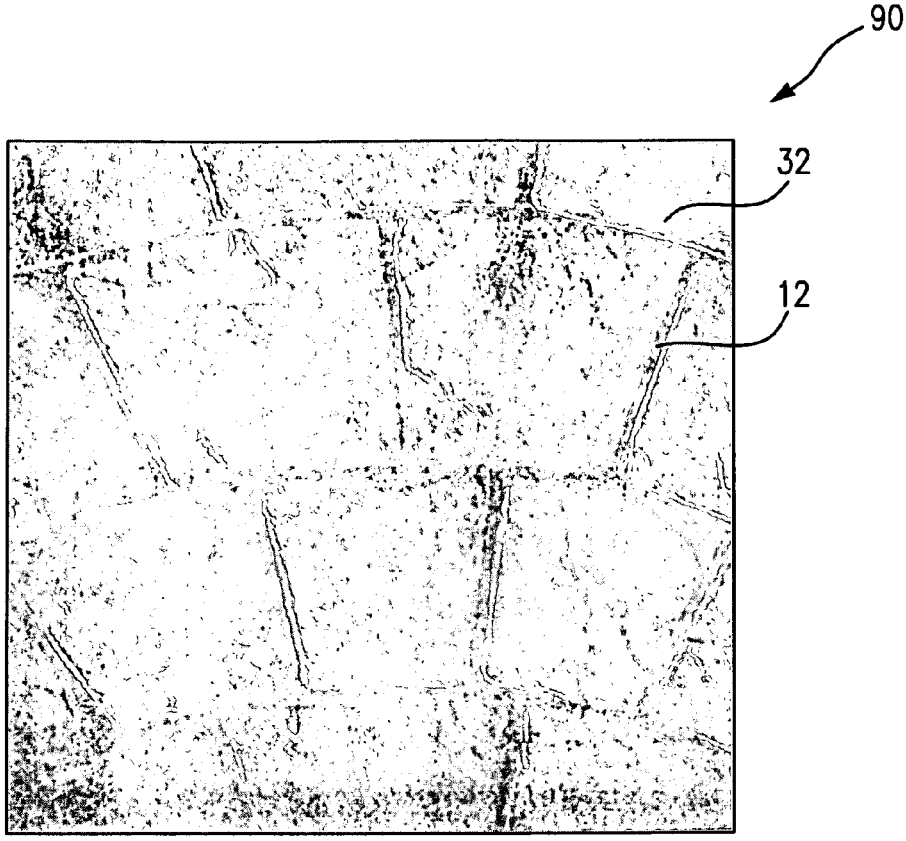
FIG. 10 is an example of a curved pathway created using a method of this invention.

FIG. 10 shows an example of a curved pathway 90 created using the method of this invention described above.

Thus, the invention provides an apparatus and method for simulating the look of individually laid materials in a curved pattern.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. An apparatus for stamping uncured concrete comprising:

a flexible spine movable from a generally linear profile to a curved profile;

a plurality of ribs extending generally perpendicular from the flexible spine in the generally linear profile, wherein the plurality of ribs extend generally perpendicular from a tangent of the curved profile; and wherein the flexible spine is pressed into the uncured concrete while in either profile.

2. The apparatus of claim 1, wherein the flexible spine further includes a tapered edge.

3. The apparatus of claim 1, wherein each of the plurality of ribs include a tapered edge.

4. The apparatus of claim 1, wherein the flexible spine includes a spine textured surface and the plurality of ribs include a rib textured surface.

5. The apparatus of claim 1 further including:

a mat with a negative relief.

6. The apparatus of claim 5, wherein the negative relief includes one of a surface pattern for a brick, a stone and a wood grain.

7. The apparatus of claim 1 further including:

a second flexible spine with a tapered edge and movable from a generally linear profile to a curved profile.

8. The apparatus of claim 1, wherein the flexible spine includes a flat section between the plurality of ribs and the plurality of ribs are formed in a trapezoidal shape.

9. An apparatus for stamping uncured concrete comprising:

an irregular flexible spine movable from a generally straight profile to a generally curved profile;

a plurality of generally irregular ribs extending from the irregular flexible spine, wherein the plurality of generally irregular ribs extend from the irregular flexible spine;

a mat with a negative relief of a stone surface pattern; and wherein the irregular flexible spine is pressed into the uncured concrete in the curved profile.

10. The apparatus of claim 9, wherein the irregular flexible spine further includes a tapered edge.

11. The apparatus of claim 9, wherein the plurality of generally irregular ribs each further include a tapered edge.

12. The apparatus of claim 9, wherein at least one of the irregular flexible spine and the plurality of irregular ribs include a textured surface.

13. The apparatus of claim 9 further comprising:

a second irregular flexible spine with a tapered edge and movable from a generally straight profile to a generally curved profile.

14. A method of forming a curved pathway in uncured concrete comprising:

curving a flexible spine with a plurality of outwardly extending ribs to a desired radius to a curved profile of the flexible spine;

pressing a lower edge of the flexible spine and a lower edge of the plurality of outwardly extending ribs into a surface of the uncured concrete while the flexible spine is in the curved profile;

removing the flexible spine and the plurality of ribs from the surface of the uncured concrete;

applying a textured mat to a surface of uncured concrete; and removing the textured mat from the surface of the uncured concrete.

15. The method of claim 14, wherein at least one of the flexible spine and the plurality of ribs includes a tapered edge.

16. The method of claim 14, wherein the textured mat includes a negative relief of a surface.

17. The method of claim 14, wherein the negative relief comprises at least one of a brick surface pattern, a stone surface pattern and a wood grain surface pattern.

18. The method of claim 14 further including:

curving a second flexible spine to a desired radius;

pressing the second flexible spine into the surface of the uncured concrete; and wherein a second flexible spine imprint left by the second flexible spine touches a flexible spine imprint left by the flexible spine to complete a border around a simulated material.

19. The method of claim 14 further including:

applying a release agent to the uncured concrete prior to pressing the flexible spine and the plurality of ribs into the surface of the uncured concrete.

* * * * *